US008267621B1

(12) United States Patent
Way

(10) Patent No.: US 8,267,621 B1
(45) Date of Patent: Sep. 18, 2012

(54) FLOATING BOATLIFT

(76) Inventor: Robert L. Way, St. Augustine, FL (US)

( * ) Notice: Subject to any disclaimer, the term of this patent is extended or adjusted under 35 U.S.C. 154(b) by 95 days.

(21) Appl. No.: 12/775,118

(22) Filed: May 6, 2010

Related U.S. Application Data

(60) Provisional application No. 61/176,345, filed on May 7, 2009.

(51) Int. Cl.
*B63C 3/06* (2006.01)

(52) U.S. Cl. ..... 405/3; 114/44

(58) Field of Classification Search ..... 405/1–7; 114/44–48
See application file for complete search history.

(56) References Cited

U.S. PATENT DOCUMENTS

| | | | | |
|---|---|---|---|---|
| 3,114,535 | A * | 12/1963 | Burch | 254/127 |
| 4,111,144 | A * | 9/1978 | Ingvason | 114/48 |
| 5,131,342 | A * | 7/1992 | Sackett | 114/48 |
| 5,390,616 | A * | 2/1995 | Roth | 114/44 |
| 5,655,850 | A * | 8/1997 | Holmgren | 405/3 |
| 7,066,683 | B2 * | 6/2006 | Way | 405/3 |
| 7,117,805 | B2 * | 10/2006 | Shackelford, Jr. | 114/44 |
| 7,413,378 | B2 * | 8/2008 | Way | 405/4 |
| 7,503,274 | B2 * | 3/2009 | Weed et al. | 114/45 |
| 7,509,916 | B1 * | 3/2009 | Nelson, Jr. | 114/45 |

* cited by examiner

*Primary Examiner* — Sunil Singh
(74) *Attorney, Agent, or Firm* — Arthur G. Yeager

(57) ABSTRACT

A floating boatlift assembly includes a cradle assembly suspended between cable handling units arranged on respective spaced parallel float assemblies. An elongated boat is positioned between the float assemblies and over the cradle assembly. The cable handling units are operated to lift the boat into a raised position and permit lowering thereof to float the boat in water.

11 Claims, 4 Drawing Sheets

FLOATING BOATLIFT

CROSS-REFERENCE TO RELATED APPLICATION

This application claims the benefit of U.S. Provisional Application Ser. No. 61/176,345, filed on May 7, 2009, the contents of which are herein incorporated by reference in their entirety.

FIELD OF THE INVENTION

The present invention relates to boatlifts, and more particularly, to boatlifts powered by hydraulic cylinders.

BACKGROUND OF THE INVENTION

A relatively recent innovation in boatlifts includes the use of hydraulic cylinders to raise and lower boats. In one such boatlift, a cradle for carrying a boat is mounted between opposed pilings. A pair of hydraulic cylinders with horizontally extensible rods are mounted in housings affixed to the pilings on either side of the cradle. The rods are connected to the cradle by cables routed through a plurality of sheaves such that horizontal motion of the rods are translated into vertical motion of the cradle. An example of this type of boatlift is described by U.S. Pat. No. 7,413,378, the contents of which are hereby incorporated by reference in their entirety.

In areas with substantial local variations in water level, such as tidal changes, the required lift cradle travel distance can vary substantially. For example, the required lift cradle travel distance at low tide can be several feet greater than at high tide. As a result, a significantly more complex and robust arrangement of hydraulic cylinders and sheaves may be required to accommodate the lift cradle travel distance at low tide than are needed at high tide.

SUMMARY OF THE INVENTION

In view of the foregoing, it is an object of the present invention to provide a floating boatlift assembly. According to an embodiment of the present invention, a floating boatlift assembly includes a cradle assembly suspended between cable handling units arranged on respective spaced parallel float assemblies. An elongated boat is positioned between the float assemblies and over the cradle assembly. The cable handling units are operated to lift the boat into a raised position and permit lowering thereof to float the boat in water. Since the cable handling units are arranged on float assemblies, they will rise and fall with variations in local water levels, eliminating the need for additional vertical travel capability in low water level situations.

These and other objects, aspects and advantages of the present invention will be better understood in view of the drawings and the following detailed description of preferred embodiments.

DETAILED DESCRIPTION OF PREFERRED EMBODIMENTS

Figure 1:
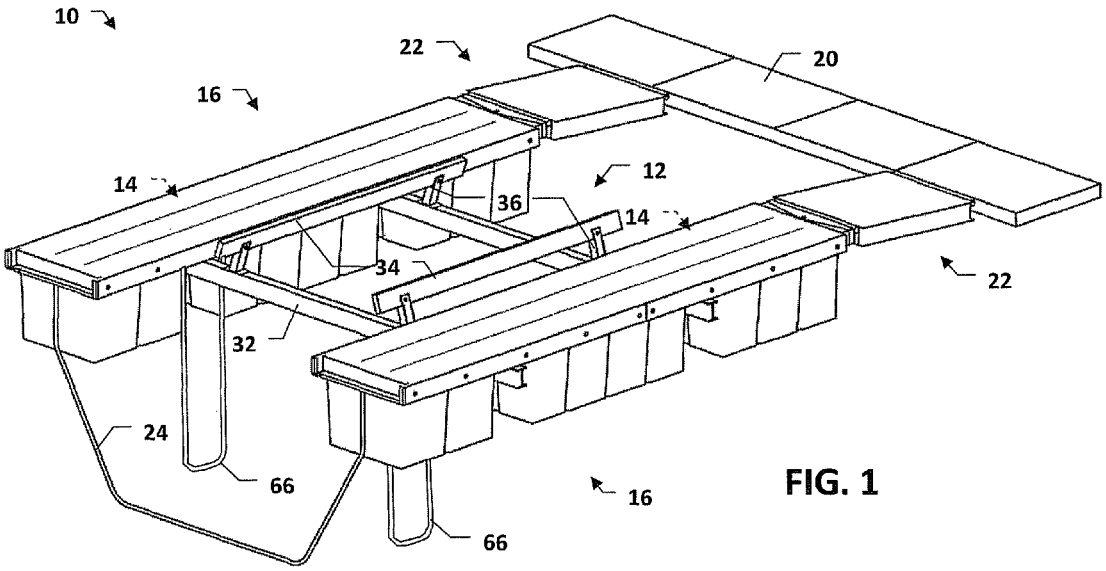
FIG. 1 is perspective view of a floating boatlift assembly, including a cradle assembly, cable handling units and float assemblies, according to an embodiment of the present invention.

Referring to FIG. 1, according to an embodiment of the present invention, a floating boatlift assembly 10 includes a cradle assembly 12 suspended between cable handling units 14 arranged on respective float assemblies 16. The float assemblies 16 are connected to a main dock 20 by bridge assemblies 22. A steadying brace 24 maintains a predetermined distance between the float assemblies 16. When cradle assembly 12 is in a position other than fully raised, the brace 24 is used to steady float assemblies 16 when cross-members 32 are lowered away from wedge locks 38, 40, as hereinafter described.

Figure 2:
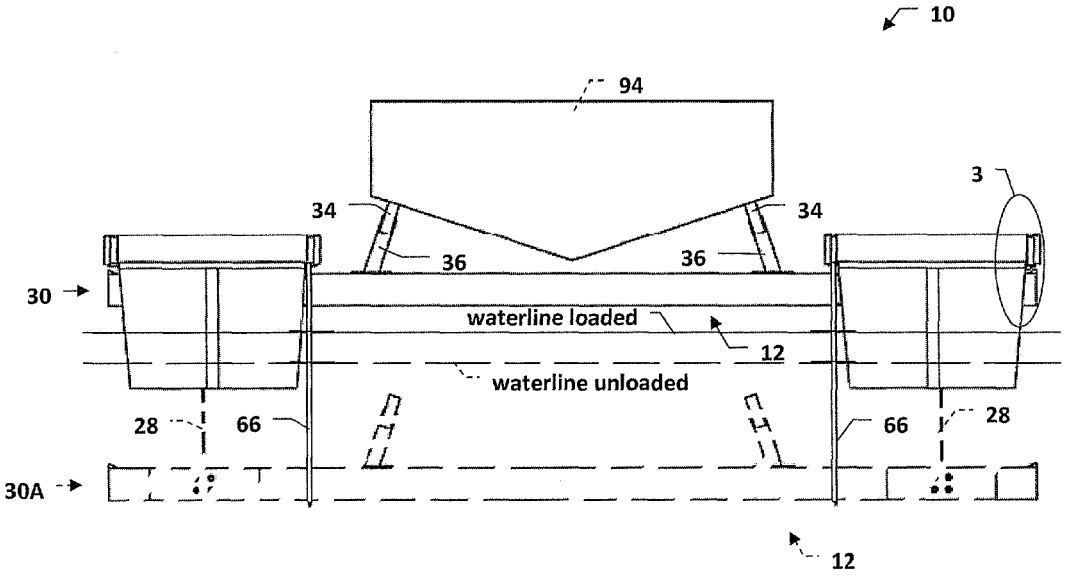
FIG. 2 is an end view of the cradle assembly and float assemblies of FIG. 1.
Figure 3:
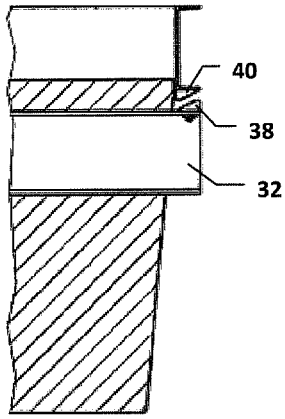
FIG. 3 is a detailed view of area 3 of FIG. 2, in partial section.

Referring to FIGS. 1 and 2, the cradle assembly 12 is suspended by cables 28 from the cable handling units 14 and moveable thereby between a raised position 30 and lowered position 30A (cradle assembly 12 in broken lines). The cradle assembly 12 includes cross-members 32 with bunk rails 34 extending therebetween. The bunk rails 34 are connected to each cross-member 32 by respective bunk risers 36. Referring to FIGS. 2 and 3, wedge locks 38 are located at the ends of the cross-members 32 for engaging corresponding wedge locks 40 on the float assemblies 16 with the cradle assembly 12 being in the raised position 30. These wedge locks 38 engage wedge locks 40 in the raised position 30 resulting in the entire floating assembly 10 being tied together by forces from cross-members 32, raised up against locks 40.

Figure 4:
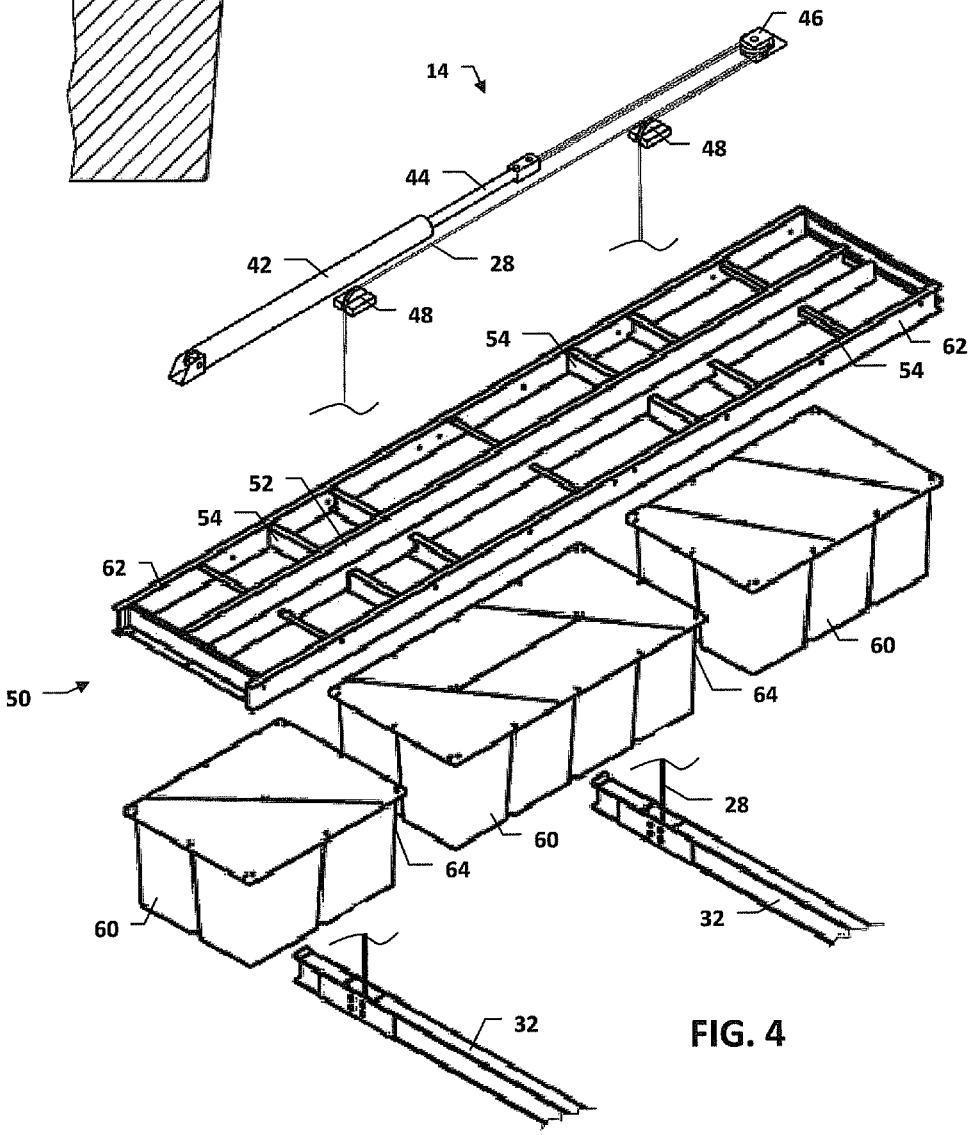
FIG. 4 is a perspective view of components of a representative one of the cable handling units and float assemblies of FIG. 1.

Referring to FIG. 4, the cable handling units 14 each include a hydraulic cylinder 42 with a cylinder rod 44 connected to the cables 28. The cable handling units 14 further include a double groove sheave 46 around which the cables 28 are both wrapped approximately 180 degrees and downward transition sheaves 48 about which the cables 28 turn approximately 90 degrees to tend downward to the cradle assembly 12. The sheaves 46, 48 preferably include respective sheave wheels and blocks.

Also, each cable handling unit 14 has a frame assembly 50, having a longitudinal member 52 to which the hydraulic cylinder 42 and sheaves 46, 48 are mounted. The longitudinal member 52 preferably is formed with a c-shaped cross-section. The frame assembly 50 additionally includes spaced spars 54 extending substantially perpendicular to the longitudinal member 52. The frame assembly 50 distributes the forces acting on the cable handling unit 14 across the float assembly 16 and includes attachment points thereto.

Figure 5:
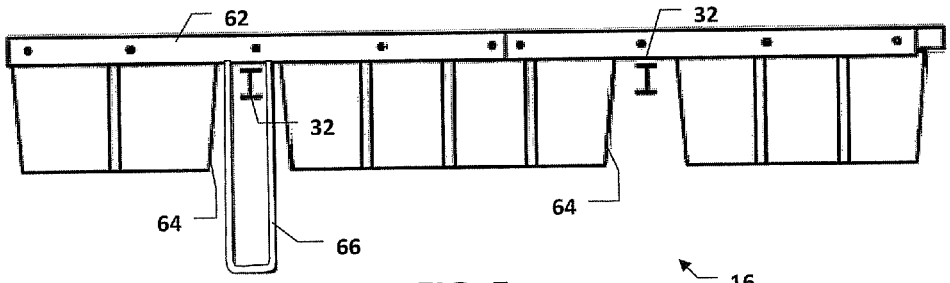
FIG. 5 is a side view of the representative one of the float assemblies of FIG. 1.

Referring to FIGS. 4 and 5, the float assemblies 16 each include at least one float 60 and a plurality of walers 62 connected thereto. The floats 60 have a plurality of spaced channels 64 defined therebetween (or therein, for a unitary float) for accommodating the cross-members 32 during raising of the cradle assembly 12. Each float assembly 16 also includes at least one cross-member guide 66 for ensuring that the cross-members 32 remain aligned with the channels 64.

Figure 6:
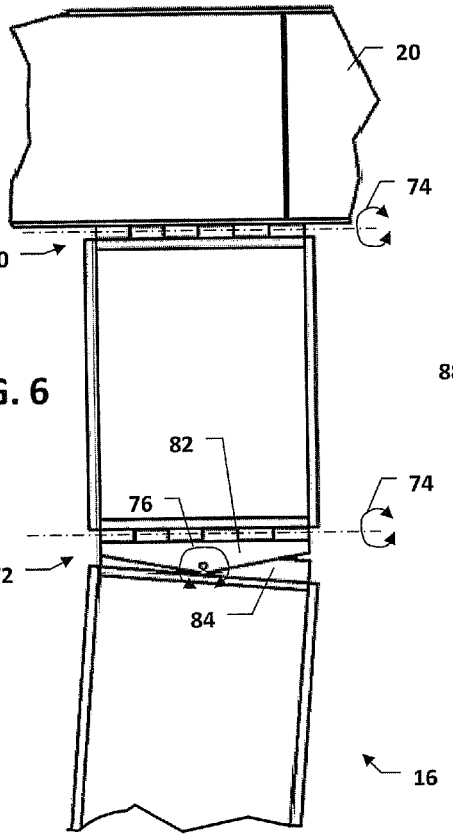
FIG. 6 is a top view of a connection bridge assembly connected to the representative one of the float assemblies.

Referring to FIG. 6, the connection bridge assemblies 22 extend between the main dock 20 and the float assemblies 16. Each bridge assembly 22 includes a bridge structure with a first hinge assembly 70 and a second hinge assembly 72. The hinge assemblies 70, 72 are each rotatable about a first parallel axis, in the direction of arrows 74, to allow the float assemblies 16 to move up and down relative to the main dock 20. The second hinge assembly 72 is also rotatable about a second axis, in the direction of arrow 76, to allow the float assemblies 16 a degree of side to side rotation relative to the main dock 20, for instance under the influence of a boat impacting on one of the float assemblies 16.

Figure 7:
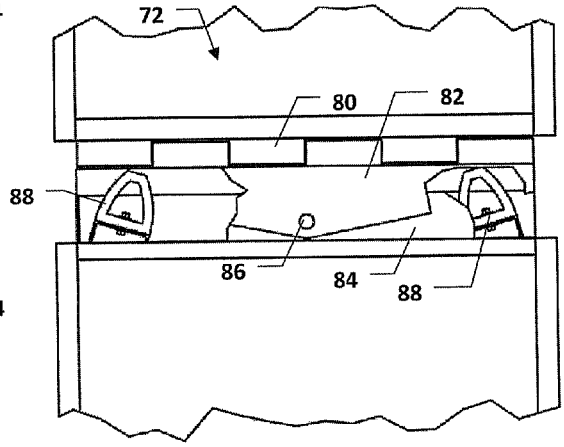
FIG. 7 is a detailed view of area 7 of FIG. 6, in an alternate position.

Referring to FIG. 7, the second hinge assembly 72 includes a piano-type hinge 80. The first hinge 70 is substantially similar in construction to the piano-type hinge 80 of the second hinge assembly 72. The second hinge assembly 72 also includes outer plates 82 (only an upper plate shown) connected to inner plates 84 (only an upper plate shown), by a pivot pin 86. Compression bumpers 88 are arranged on both sides of the pivot pin 86 and supply a return force when either bumper is compressed by side-to-side rotation of the float assembly 16 relative to the main dock 20.

Referring to FIGS. 1 and 2, in operation of the floating boatlift assembly 10, a boat 94 is maneuvered between the float assemblies 16 with the cradle assembly 12 in the lowered position 30A. Hydraulic fluid is ported to and vented from the hydraulic cylinders 42 (see FIG. 4) of the cable handling units 14 to retract the cylinder rods 44. As a result, the cradle assembly 12 is lifted by the cables 28 into the raised position 30 shown in FIG. 2.

The weight of the boat 94 causes the float assemblies 16 to sit lower in the water and the bridge assemblies 22 allow the float assemblies 16 to move independently of the main dock 20, such that the water level of the main dock 20 is substantially unaffected by the operation of the floating boatlift assembly 10.

To lower the floating boatlift assembly 10, hydraulic fluid is ported to and vented from the hydraulic cylinders 42 (see FIG. 4) of the cable handling units 14 to extend the cylinder rods 44. As a result, the cradle assembly 12, under its own weight, and for a portion of the downward travel, the weight of the boat 94, sinks to the lowered position 30A.

Preferably, a single hydraulic plant (not shown) is located on the main dock 20 to supply hydraulic fluid to, and receive hydraulic fluid from, the hydraulic cylinders 42. The hydraulic plant can include a balancing valve arrangement for facilitating even and equal displacement of the cylinder rods 44. "Dead man" type controls can be employed to actuate the raising and lowering of the cradle assembly 12, such that release of the controls will automatically cease operation in either direction.

From the foregoing, it will be appreciated that the floating lift assembly 10 does not need to accommodate for larger variations in local water levels due to tides and other factors. Thus, the required stroke of the hydraulic cylinders 42 is minimized and smaller bore cylinders can be employed for a given boat weight. Additionally, fewer sheaves are required to contain the cable handling unit 14 within a given amount of space. Moreover, a marina or other floating boatlift assembly 10 owner/operator does not need to use a particular extent of waterfront to locate a boatlift. Also, the floating boatlift assembly 10 can be used as a conventional slip, if desired.

The foregoing embodiment is provided for illustrative and descriptive purposes; the present invention is not necessarily limited thereto. Rather, those skilled in the art will appreciate that various modifications, as well as adaptations for particular circumstances, are possible within the scope of the present invention.

Figure 8:
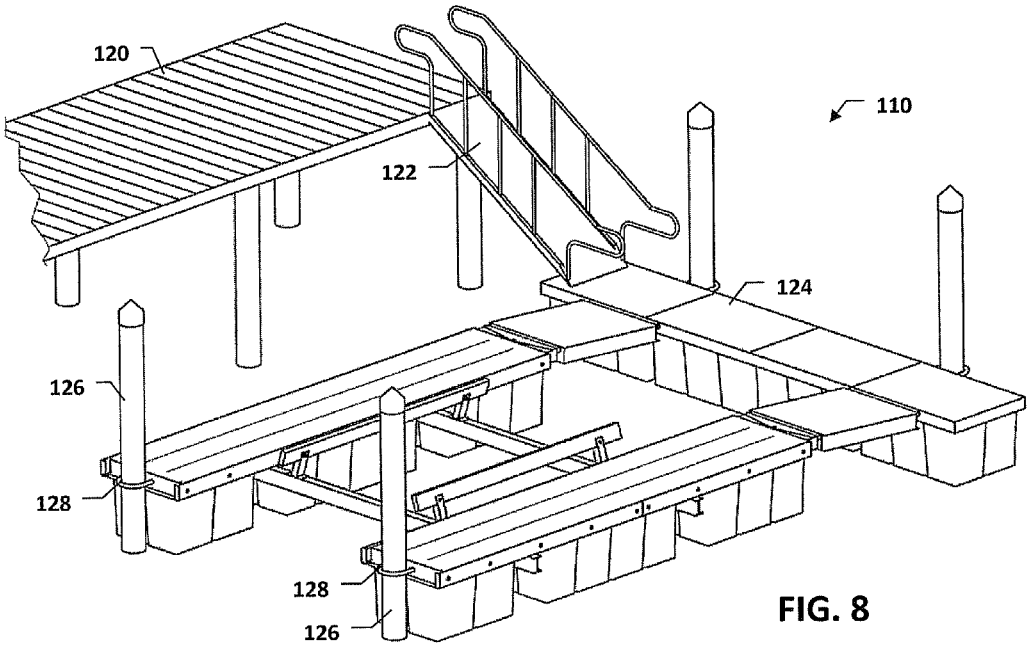
FIG. 8 is a perspective view of a floating boatlift assembly, according to another embodiment of the present invention.

For example, referring to FIG. 8, in situations where a floating main dock is unavailable, a floating boatlift assembly 110 can be connected to main elevated fixed dock 120 by an access ramp 122 and an intermediate floating dock 124 can be provided. Alternately, connection bridges with sufficient range of motion to connect directly with the elevated fixed dock could be used.

Additionally, to supply the floating boatlift assembly 110 with greater resistance to cross currents, steadying pilings 126 could be used at ends of respective float assemblies 116. Pile collars 128 attached to the float assemblies 116 slidably mate the steadying pilings 126 with the float assemblies 116.

Figure 9:
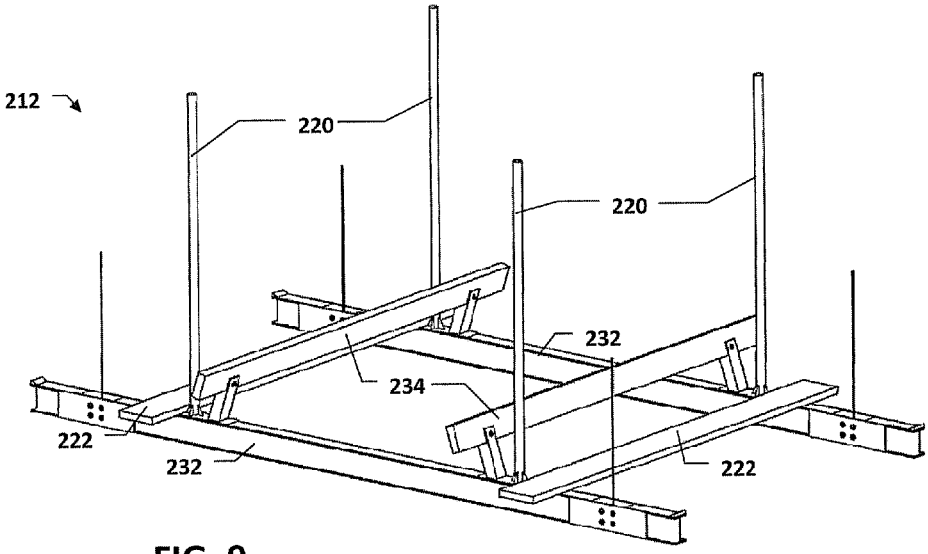
FIG. 9 is a perspective view of a floating boatlift assembly, according to a further embodiment of the present invention.

Referring to FIG. 9, a cradle assembly 212 can include guideposts 220 to facilitate proper positioning of a boat over bunk rails 234. Also, catwalks 222 can be attached between cross-members 232, increasing the stiffness of the cradle assembly 212 and offering additional walking surfaces when the cradle assembly 212 is raised.

The foregoing is not an exhaustive list of possible variations. Instead, those skilled in the art will appreciate that these and other modifications and adaptations may fall within the scope of the invention herein shown and described, and of the appended claims.

What is claimed is:

1. A floating boatlift assembly comprising:

a pair of generally parallel spaced-apart elongated and generally parallel float assemblies for receiving an elongated boat hull therebetween;

a cradle assembly extending between the float assemblies and adapt to support such boat hull thereon;

a first pair of spaced cables extending from the cradle assembly;

a first cable handing unit arranged on a first of the float assemblies and connected to the first pair of cables and operable to move the cradle assembly;

a second pair of spaced cables extending from the cradle assembly;

a second cable handling unit arranged on a second of the float assemblies and connected to the second pair of cables and operable together with the first cable handling assembly to raise the cradle assembly into the raised position out of water with the first and second pair of spaced cables and operable to permit lowering of the cradle assembly into the lowered position to float such boat hull in water;

each of the first and second cable handling units includes a hydraulic cylinder and a cylinder rod respectively connected to the first and second pair of spaced cables;

each of the first and second cable handling units further includes a double groove sheave and a pair of downward transition sheaves through which the first and second pair of spaced cables are routed;

the cradle assembly includes at least a pair of spaced cross members extending between the float assemblies;

each of the floating assemblies define a channel for movably accommodating at least one of the pair of spaced cross-members therein during raising and lowering of the cradle assembly;

at least one of the floating assemblies includes a cross-member guide aligned with and extending below the channel of the float assembly for guiding the cross-member into the channel during raising of the cradle assembly and to maintain the cross-member generally vertically aligned with the channel when the cross-member is below bottoms of the float assemblies; and the cross-members and the float assemblies include a plurality of complementary wedge locks, the wedge locks engaging when the cradle assembly is in the raised position.

2. The assembly of claim 1 wherein the cradle assembly further includes a pair of bunk rails connected to the cross-member and a pair of guide posts to facilitate positioning of a boat over the bunk rails.

3. The assembly of claim 1 wherein the cradle assembly includes at least one catwalk extending between the cross-members adjacent one of the float assemblies.

4. The assembly of claim 1, further comprising a steadying brace extending between the float assemblies at an entryway for a boat hull, said brace extending below water and being unobtrusive to ingress and egress of a such boat hull.

5. The assembly of claim 1, wherein an end of each of the float assemblies is adapted for slidable attachment to a respective piling.

6. The assembly of claim 1, further comprising a pair of connection bridge assemblies, a first end of each connection bridge assembly being connected to respective ends of the pair of float assemblies and a second end of each connection bridge assembly being adapted for connection to a main dock.

7. The assembly of claim 6, wherein each of the connection bridge assemblies includes first and second hinge assemblies, the first hinge and second hinge assemblies being rotatable about a first substantially parallel axis to allow relative up and down movement between the float assemblies and the main dock, and each of the second hinge assemblies being pivotable about a second axis substantially perpendicular to the first axis to allow side-to-side motion between the float assemblies and the main dock.

8. A floating boatlift assembly comprising:

a cradle assembly including a pair of generally parallel cross-members with a pair of generally parallel elongated bunk rails extending therebetween adapted to support a boat hull thereon;

first and second spaced-apart elongated float assemblies generally parallel with the bunk rails, a pair of channels being defined in each of the float assemblies to accommodate respective ends of the cross-members therein during raising of the cradle assembly;

first and second pair of spaced cables extending from the cradle assembly under the first and second float assemblies; respectively;

first and second cable handling units arranged on the first and second float assemblies, respectively and operable in coordination to raise the cradle assembly into a raised position out of water with the first and second pair of spaced cables and operable to permit lowering of the cradle assembly into a lowered position to float a boat hull in water;

each of the first and second float assemblies include respective first and second cross-member guides for guiding one of the cross-members into the channels during raising of the cradle assembly and to maintain the cross-member generally vertically aligned with the channel when the cross-member is below bottoms of the float assemblies; and the first and second cable handling units each include:

a frame assembly respectively connected to the first and second float assembly;

a hydraulic cylinder mounted to the frame assembly in a generally horizontal plane:

a cylinder rod slidably displaceable within the hydraulic cylinder:

a pair of downward transition sheaves respectively connected to the first and second float assembly for routing the respective first and second pairs of cables into the horizontal plane; and a double groove sheave for routing each pair of cables around an approximately 180 bend and toward the hydraulic cylinder and cylinder rod.

9. The assembly of claim 8, further comprising a pair of connection bridge assemblies, a first end of each connection bridge assembly being connected to respective ends of the first and second float assemblies and a second end of each connection bridge assembly being adapted for connection to a main dock.

10. The assembly of claim 9, wherein each of the connection bridge assemblies includes first and second hinge assemblies, the first hinge and second hinge assemblies being rotatable about a first substantially parallel axis to allow relative up and down movement between the float assemblies and the main dock, and the second hinge assembly being pivotable about a second axis substantially perpendicular to the first axis to allow side-to-side motion between the float assemblies and the main dock.

11. The assembly of claim 8 wherein the cross-members and the float assemblies include a plurality of complementary wedge locks, the wedge locks engaging when the cradle assembly is in the raised position.

* * * * *